US005771859A

United States Patent [19]

Schlagmueller et al.

[11] Patent Number: 5,771,859

[45] Date of Patent: Jun. 30, 1998

[54] METHOD AND ARRANGEMENT FOR CONTROLLING THE IDLE OF AN INTERNAL COMBUSTION ENGINE

[75] Inventors: Walter Schlagmueller, Schwieberdingen; Thomas Wiesa, Vaihingen; Rolf Litzinger, Hechingen; Juergen Rottler, Karlsruhe; Ralph Schimitzek, Obersulm/Sulzbach; Peter Jauernig, Tiefenbronn, all of Germany

[73] Assignee: Robert Bosch GmbH, Stuttgart, Germany

[21] Appl. No.: 731,738

[22] Filed: Oct. 18, 1996

[30] Foreign Application Priority Data

Oct. 18, 1995 [DE] Germany ..... 195 38 786.4

[51] Int. Cl.[6] ..... F02D 41/16

[52] U.S. Cl. ..... 123/339.11; 123/339.12; 123/339.15; 123/339.23

[58] Field of Search ..... 123/339.11, 339.15, 123/339.23, 519, 520, 339.12; 73/118.1

[56] References Cited

U.S. PATENT DOCUMENTS

| | | | |
|---|---|---|---|
| 5,203,300 | 4/1993 | Orzel | 123/520 X |
| 5,215,055 | 6/1993 | Orzel | 123/520 X |
| 5,243,853 | 9/1993 | Steinbrenner et al. | 73/117.3 |
| 5,588,409 | 12/1996 | Mizuno et al. | 123/339.15 X |

*Primary Examiner*—Tony M. Argenbright
*Attorney, Agent, or Firm*—Walter Ottesen

[57] ABSTRACT

The invention is directed to a method for controlling the idle of an internal combustion engine having an intake channel for conducting air to the engine. The method utilizes sensors for generating signals characterizing the operating state of the engine and for supplying the signals to a control apparatus. A tank-venting valve is provided through which air can be conducted into the intake channel when the tank-venting valve is open. Control quantities are computed in the control apparatus in dependence upon the signals for at least the following: the tank-venting valve, an idle adjuster device, a fuel metering device and an ignition device. The air supplied to the engine is controlled with the aid of the tank-venting valve. The invention is also directed to an arrangement for carrying out the method.

5 Claims, 1 Drawing Sheet

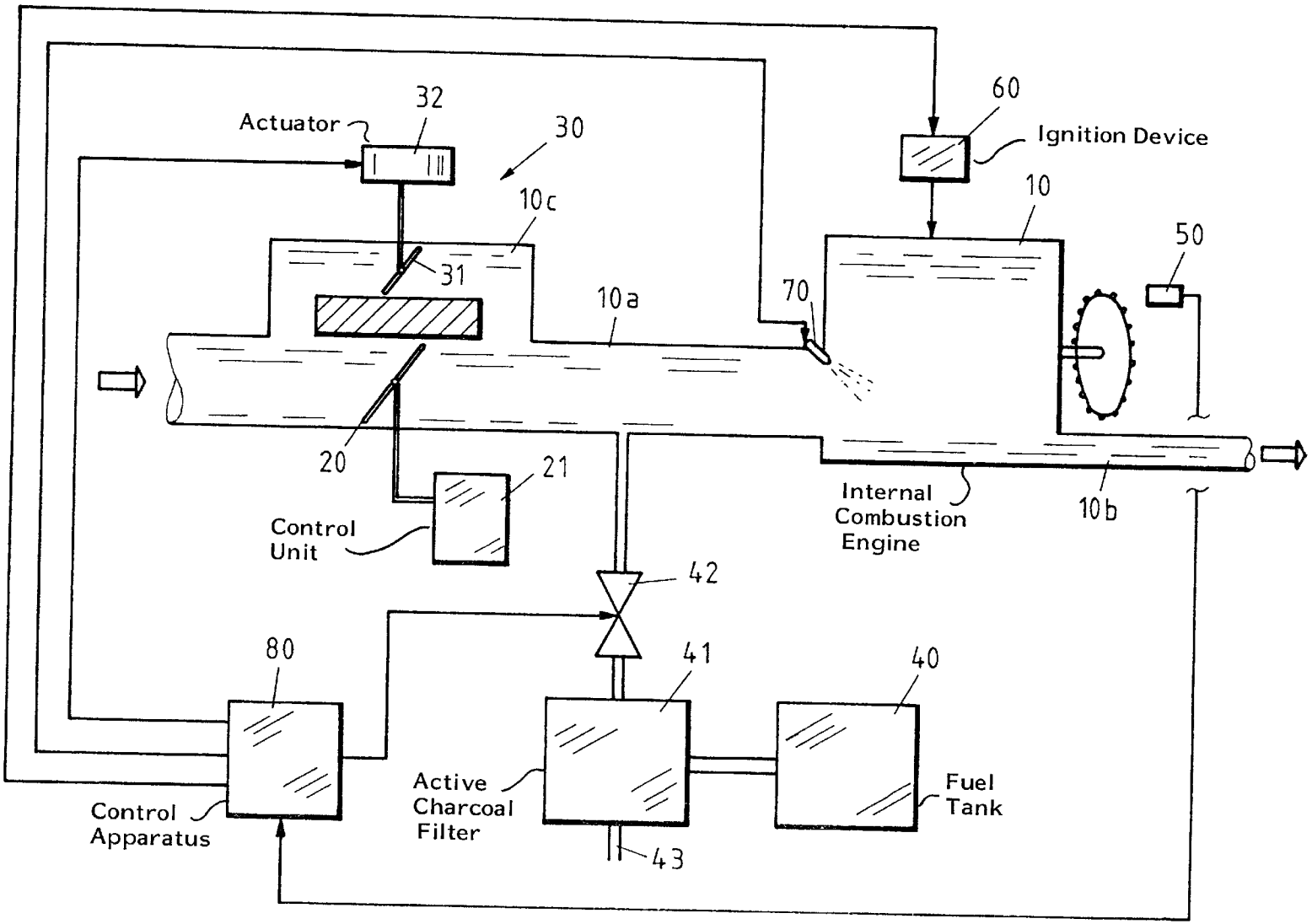
Ignition Device
60
10
50
10b
Internal Combustion Engine
70
10a
30
10c
32
31
Actuator
20
21
Control Unit
42
41
40
Fuel Tank
43
Active Charcoal Filter
80
Control Apparatus

METHOD AND ARRANGEMENT FOR CONTROLLING THE IDLE OF AN INTERNAL COMBUSTION ENGINE

BACKGROUND OF THE INVENTION

It is known to trap escaping gasoline vapors from a tank during operation of an internal combustion engine essentially for reasons of environmental protection. This usually takes place with the aid of an active charcoal filter which is scavenged via a clocked driven tank-venting valve into the intake region of the engine. In this way, the active charcoal filter is regenerated.

U.S. Pat. No. 5,243,853 discloses a method and an arrangement for checking whether a tank-venting valve and an idle actuator can-be driven. In this method, control variables for at least the tank-venting valve, the idle air and the metering of fuel are computed by an electronic control apparatus which receives signals from sensors such as an air-flow sensor, an rpm sensor or a lambda probe. Regeneration vapor flows are supplied to the intake region of the engine during operation via a corresponding control of the tank-venting valve. A conclusion as to the operability of the control chain assigned to the tank-venting valve and the idle control is drawn from a comparison of quantities, which are computed by the electronic control apparatus, to pregiven values.

The method disclosed in U.S. Pat. No. 5,243,853 permits carrying out a diagnosis of the actuator for the area of tank venting during operation of a motor vehicle and while the engine is running. This diagnosis is essentially independent of the air/fuel ratio of the regenerating vapor flow. The clocked drive of the tank-venting valve is used only to scavenge the gasoline vapors, which are adsorbed in the active charcoal filter, into the intake region of the engine.

In addition to scavenging the active charcoal filter, the tank-venting valve and the possibility of driving the tank-venting valve is in no way utilized during operation of the engine. A vapor flow arises with the actuation of the tank-venting valve. The possibility is not realized to utilize this vapor flow in any way for controlling the running of the engine.

SUMMARY OF THE INVENTION

In view of the above, it is an object of the invention to utilize the tank-venting valve and the possibility of driving the tank-venting valve to control the operation of an engine and especially to control the idle of the engine. It is especially an object to use the drive of the tank-venting valve to control the idle when there is a defective idle actuator or a defective throttle flap. In this way, advantageous running characteristics of the engine and especially emergency running of the engine is made possible.

The method of the invention is for controlling the idle of an internal combustion engine having an intake channel for conducting air to the engine. The method comprises the steps of: utilizing sensors for generating signals characterizing the operating state of the engine and for supplying the signals to a control apparatus; providing a tank-venting valve through which air can be conducted into the intake channel when the tank-venting valve is open; computing control quantities in the control apparatus in dependence upon the signals for at least the following: the tank-venting valve, an idle adjuster device, a fuel metering device and an ignition device; and, controlling the air supplied to the engine with the aid of the tank-venting valve.

It is especially advantageous to control the air flow to the engine with the aid of the tank-venting valve. In this way, the tank-venting valve can be used to control the idle of the engine while, at the same time, scavenging gasoline vapors, which are trapped in the active charcoal filter, and flushing these vapors into the intake region of the engine. In addition to the vapor flow supplied by the idle actuator, an additional vapor flow is supplied to the engine in idle operation via a controlled opening and closing of the tank-venting valve. This makes possible not only a significantly more precise control of idle of the engine but also a simpler and therefore more cost-effective configuration of the idle actuator.

Thus, it is, for example, especially advantageous that an emergency operation of the engine is made possible especially for a defective idle actuator because of the possibility to control the air supply to the engine with the aid of the tank-venting valve. In addition to the control of the air flow with the aid of the tank-venting valve, a throttling of the engine is undertaken which, for example, is achieved via a shift of the ignition angle and/or a reduction of the injected fuel quantity.

In this way, operation is not limited only to emergency operation of the engine when the idle actuator becomes inoperative. It is furthermore possible to also provide emergency operation of the engine when idle actuators are used which are not capable of emergency operation.

The use of non-emergency idle actuators is made possible which are of significantly simpler configuration and therefore can be produced at lower cost than conventional emergency idle actuators.

It is also advantageous that the method and arrangement of the invention can be used for practically any type of idle actuator. An idle flap can be provided in a bypass channel arranged parallel to the intake channel. Thus, it is, for example, possible to use the method and arrangement of the invention for such an idle flap as well as for an idle actuator which is realized by a drive of the throttle flap of the engine.

BRIEF DESCRIPTION OF THE DRAWINGS

The invention will now be described with reference to the drawing which shows a schematic of the arrangement of the invention for controlling idle of an internal combustion engine in combination with an idle control and the tank-venting system for the engine.

DESCRIPTION OF THE PREFERRED EMBODIMENTS OF THE INVENTION

The basic idea of the invention comprises driving the tank-venting valve to control the idle of an internal combustion engine and especially for making possible an emergency operation of the engine when the idle actuator is defective.

The method of controlling the idle of an internal combustion engine can be explained best in combination with the arrangement shown in the drawing for controlling the idle of the engine.

As shown in the drawing, an engine 10 includes an intake channel 10*a* and an exhaust-gas channel 10*b*. A throttle flap 20 is mounted in the intake channel 10*a* and can, for example, be adjusted electronically via the control unit 21 in the case of an electronic accelerator pedal or the throttle flap can be controlled mechanically as known per se via a cable (not shown) in dependence upon the position of the accelerator pedal.

Furthermore, an idle actuator device 30 is mounted in the intake channel 10*a* which, for example, can be realized by an idle flap 31 mounted in a bypass channel 10*c*. The idle flap 31 can be adjusted via an actuator 32. In this context, it is noted that the control of the idle vapor flow must not perforce take place via a bypass line 10*c*. In lieu thereof, an idle adjuster is also possible which itself drives the throttle flap 20. Basically, any type of idle adjuster can be utilized.

Furthermore, a fuel-vapor holdback system of a fuel tank 40 is provided. This fuel-vapor holdback system essentially includes an active charcoal filter 41 and a tank-venting valve 42. The tank-venting valve connects the outlet of the active charcoal filter 41 to the intake region of the engine 10. An opening into the intake channel 10*a* of the engine 10 is mounted downstream of the throttle flap 20 and the idle adjuster device 30.

Furthermore, an rpm transducer 50 is provided which inductively detects the teeth of a toothed wheel driven by the engine 10 in order to detect the rpm of the engine. An ignition device 60 and a fuel injection system are also provided The fuel injection system is illustrated symbolically by an injection valve 70 mounted in the intake region 10*a* of the engine 10.

Finally, an electronic control apparatus 80 is provided which drives the actuator 32 of the idle adjuster device 30, the fuel injection system (that is, the injection valve 70), the ignition device 60 and the tank-venting valve 42 all in dependence upon the value of the rpm as it is detected by the rpm transducer 50.

To control the idle of the engine 10, the rpm of the engine is continuously detected via the rpm transducer 50 and the signal detected by the rpm transducer 50 is supplied to the control apparatus 80. The control apparatus 80 computes the control quantities for the tank-venting valve 42, the idle adjuster device 30, the fuel metering and the ignition 60 and transmits these variables to the corresponding actuators.

The tank-venting valve 42 is opened to scavenge the active charcoal filter 41 whereby atmospheric air is drawn into the intake channel 10*a* by suction via an opening 43 and the active charcoal filter. This in-flowing air scavenges and regenerates the active charcoal filter 41.

In an advantageous manner, a vapor flow through the opening of the tank-venting valve 42 is conducted into the intake channel 10*a* of the engine 10 and is utilized to control the idle. In this way, not only a control of the idle of the engine 10 is provided by controlling the air supply to the engine 10 with the aid of tank-venting valve 42 but, at the same time, a regeneration of the fuel vapor holdback system is achieved with this control.

Vapor flow is drawn in additionally via the active charcoal filter 41 and the tank-venting valve 42. With this vapor flow, the idle adjuster device 30 can be configured for a lower vapor flow throughput and, in this way, a technically simpler and therefore more cost effective manufacture is provided.

It is especially noted that the control of the air supply of the engine 10 makes possible an emergency operation of the engine when the idle adjuster device 30 is defective with the aid of the tank-venting valve 42 during idle. If the defect is, for example, caused by a closed frozen idle flap 31, then the idle is ensured by an air supply to the engine 10 and, in this way, an emergency operation of the engine 10 is made possible. The air supply is controlled by means of the tank-venting valve 42.

In addition to the controlled opening and closing of the tank-venting valve 42, a throttling of the engine is undertaken which is achieved, for example, by adjusting the ignition angle and/or by reducing the injected fuel quantity via the injection valve 70. In this connection, the control apparatus 80 takes care of the following: the optimal opening/closing of the tank-venting valve 42, the adjustment of the ignition angle and/or the reduction of the injected fuel quantity.

The foregoing furthermore affords the advantage that the idle adjuster device 30 must not be configured as a device capable of emergency operation and is also significantly simpler and less costly to manufacture than a conventional idle adjustor capable of emergency operation.

Basically, a significantly improved use of available equipment of the engine and the control thereof is provided.

Finally, it is noted that the electronic control apparatus 80 can be in the form of an analog, digital or a hybrid configuration. It is also possible that the control apparatus 80 includes areas of program-controlled digital systems such as microcomputers, microprocessors, digital and analog logic circuits and the like. Finally, the control apparatus can also be a component of a central engine control.

Furthermore, it is noted that, in addition to the control of the idle of an engine by means of the tank-venting valve, a control with the throttle flap is possible with the latter being entirely open or only partially open. In this operating state, a fine regulation of the control of the engine is achieved via an additional controlled air supply via the active charcoal filter 43 and the tank-venting valve 42. This is especially then advantageous when the engine 10 is loaded by power-consuming equipment which is either additionally switched on or switched off especially during idle such as the switching on of the compressor of the climate control system. With this fine regulation of the operation of the engine, the reduction in power can be compensated in a simple manner with this drop in power being caused by the switching in of a consumer such as a compressor of the climate control system.

It is understood that the foregoing description is that of the preferred embodiments of the invention and that various changes and modifications may be made thereto without departing from the spirit and scope of the invention as defined in the appended claims.

What is claimed is:

1. A method for controlling the idle of an internal combustion engine having an intake channel for conducting air to the engine, the method comprising the steps of:

utilizing sensors for generating signals characterizing the operating state of the engine and for supplying said signals to a control apparatus;

providing a tank-venting valve through which air can be conducted into the intake channel when the tank-venting valve is open;

computing control quantities in said control apparatus in dependence upon said signals for at least the following: said tank-=venting valve, and idle adjuster device, a fuel metering device and an ignition device;

controlling the air supplied to the engine with the aid of said tank-venting valve; and, throttling the engine in addition to controlling the air supplied to the engine with said tank-venting valve thereby permitting an emergency operation of said engine when the idle adjuster device is defective.

2. The method of claim 1, wherein the engine is throttled by performing at least one of the following steps: adjusting the ignition angle via said ignition device and reducing the quantity of fuel metered to said engine via said fuel metering device.

3. An arrangement for controlling the idle of an internal combustion engine having an intake channel for conducting air to the engine, the arrangement comprising:

sensing means for supplying signals characterizing the operating state of said engine;

a fuel tank;

a tank-venting valve connected to said fuel tank and being movable between an open position and a closed position;

an idle adjuster device for adjusting the air supplied to the engine via said intake channel;

a fuel metering device for metering fuel from said tank to said engine;

an ignition device for adjusting the ignition of said engine;

a control apparatus for computing and generating control quantities in dependence upon said signals and for supplying said control quantities to at least the following: said tank-venting valve, said idle adjuster device, said fuel metering device and said ignition device;

said tank-venting valve being connected to said control apparatus and being moved between said open and closed positions to control the air supplied to said engine; and, said control apparatus being adapted to control at least one of said fuel metering and ignition devices to adjust at least one of the metered fuel and ignition angle in combination with the control of the air supply to said engine to throttle the engine and make possible an emergency operation of the engine especially when there is a defective idle adjuster device.

4. The arrangement of claim 3, said intake channel being a main channel and said engine further including a bypass channel in parallel with said main channel; and, said idle adjuster device including a throttle flap pivotally mounted in said bypass channel.

5. The arrangement of claim 4, said idle adjuster device including an actuator for driving said throttle flap in response to a corresponding one of said control quantities supplied by said control apparatus.

* * * * *

UNITED STATES PATENT AND TRADEMARK OFFICE

CERTIFICATE OF CORRECTION

PATENT NO. : 5,771,859

DATED : June 30, 1998

INVENTOR(S) : Walter Schlagmueller, Thomas Wiesa, Rolf Litzinger, Juergen Rottler, Ralph Schimitzek, and Peter Jauernig It is certified that error appears in the above-identified patent and that said Letters Patent is hereby corrected as shown below:

In column 1, line 15: delete "can-be" and substitute -- can be -- therefor.

In column 2, line 37: delete "DRAWINGS" and substitute -- DRAWING -- therefor.

In column 3, line 18: delete "provided" and substitute -- provided. -- therefor.

In column 4, line 52: delete "tank-=venting" and substitute -- tank-venting -- therefor.

In column 4, line 52: delete "and" and substitute -- an -- therefor.

Signed and Sealed this

Twenty-fourth Day of August, 1999

*Attest:*

Q. TODD DICKINSON

*Attesting Officer*

*Acting Commissioner of Patents and Trademarks*